US007798485B2

(12) United States Patent
Tu et al.

(10) Patent No.: US 7,798,485 B2
(45) Date of Patent: Sep. 21, 2010

(54) DOCUMENT-FEEDING DEVICE WITH IMPROVED SHEET-SEPARATING STRUCTURE

(75) Inventors: Tung-Wen Tu, Taipei (TW); Zeng Jian, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 11/949,554

(22) Filed: Dec. 3, 2007

(65) Prior Publication Data

US 2008/0309000 A1 Dec. 18, 2008

(30) Foreign Application Priority Data

Jun. 15, 2007 (TW) ..... 96121902 A

(51) Int. Cl.
*B65H 3/52* (2006.01)
*B65H 5/34* (2006.01)

(52) U.S. Cl. ..... 271/125; 271/121; 271/167

(58) Field of Classification Search ..... 271/121, 271/167, 109, 125, 272, 122, 124
See application file for complete search history.

(56) References Cited

U.S. PATENT DOCUMENTS

| | | | | | |
|---|---|---|---|---|---|
| 650,410 | A * | 5/1900 | Morin | 271/121 |
| 3,768,803 | A * | 10/1973 | Stange | 271/34 |
| 4,588,182 | A * | 5/1986 | Nakanishi | 271/121 |
| 5,029,839 | A * | 7/1991 | Kajiwara et al. | 271/121 |
| 5,110,103 | A * | 5/1992 | Miyoshi et al. | 271/3.18 |
| 5,863,036 | A * | 1/1999 | Tanaka et al. | 271/10.11 |
| 5,927,706 | A * | 7/1999 | Hiroi et al. | 271/117 |
| 6,059,281 | A * | 5/2000 | Nakamura et al. | 271/119 |
| 6,082,729 | A * | 7/2000 | Padget | 271/121 |
| 6,390,463 | B1 * | 5/2002 | Iwago | 271/118 |
| 2002/0066994 | A1 * | 6/2002 | Nakano et al. | 271/121 |
| 2003/0160379 | A1 * | 8/2003 | Shimamura et al. | 271/10.01 |
| 2004/0070137 | A1 * | 4/2004 | Sonoda et al. | 271/121 |
| 2006/0113721 | A1 * | 6/2006 | Kim | 271/121 |
| 2006/0157913 | A1 * | 7/2006 | Sonoda et al. | 271/121 |
| 2007/0063422 | A1 * | 3/2007 | Kuo et al. | 271/121 |

FOREIGN PATENT DOCUMENTS

| | | | |
|---|---|---|---|
| JP | 61166447 | * | 7/1986 |
| JP | 62295841 | * | 12/1987 |
| JP | 63041335 | * | 2/1988 |
| JP | 63277139 | * | 11/1988 |
| JP | 03008640 | * | 1/1991 |
| JP | 04003734 | * | 1/1992 |
| JP | 04007231 | * | 1/1992 |
| JP | 05024697 | * | 2/1993 |
| JP | 06191670 | * | 7/1994 |

* cited by examiner

*Primary Examiner*—Patrick Mackey
*Assistant Examiner*—Patrick Cicchino
(74) *Attorney, Agent, or Firm*—Apex Juris, pllc; Tracy M Heims

(57) ABSTRACT

The present invention relates to a document-feeding device. The document-feeding device includes a sheet-feeding channel and a sheet-separating structure. The sheet-separating structure includes a base, a separation pad, a pinch roller, a separation roller and an elastic element. The base is disposed in the sheet-feeding channel. The separation pad is disposed on a surface of the base. The pinch roller is disposed in the base. The separation roller is in contact with the separation pad and the pinch roller. The elastic element is used for supporting the base such that the separation pad and the pinch roller are sustained against the separation roller.

4 Claims, 3 Drawing Sheets

DOCUMENT-FEEDING DEVICE WITH IMPROVED SHEET-SEPARATING STRUCTURE

FIELD OF THE INVENTION

The present invention relates to a document-feeding device, and more particularly to a document-feeding device having an improved sheet-separating structure.

BACKGROUND OF THE INVENTION

Recently, a diversity of document processing machines such as printers, facsimile machines, multifunction peripherals, scanners or automatic document feeders (ADFs) are widely used to process documents such as paper sheets. A document processing machine often has a document-feeding device for successively feeding a stack of documents into the inner portion of the document processing machine so as to implement associated operations such as scanning, faxing, scanning operations and the like. Generally, the document-feeding device has a sheet-separating structure for separating the top paper sheet from the stack of paper sheets, thereby picking a single paper sheet. As a result, the paper sheets may be transported into the document processing machine one by one.

Referring to FIG. 1, a schematic partial cross-sectional view of a conventional document-feeding device is illustrated. The document-feeding device 1 principally includes a sheet-feeding channel 11 and a sheet-separating structure 12. The sheet-feeding channel 11 is used to support the paper sheets. The sheet-separating structure 12 is disposed within the sheet-feeding channel 11, and includes a separation roller 121, a separation pad 122, a base 123 and an elastic element 124. The rotation of the separation roller 121 may facilitate transport of the paper sheet. The base 123 is received in a recess structure 111 within the sheet-feeding channel 11 for supporting the separation pad 122. The separation pad 122 is attached on the surface of the base 123. The elastic element 124 is disposed in the recess structure 111 for supporting the base 123 such that the separation roller 121 is always sustained against the separation pad 122.

The operation principle of the sheet-separating structure 12 will be illustrated as follows with reference to FIG. 1. When the frictional force between the paper sheet and the separation roller 121 is greater than the frictional force between the paper sheets or greater than the paper sheet and the separation pad 122, the uppermost paper sheet (i.e. the closest paper sheet to the separation roller 121) is nipped between the separation roller 121 and the separation pad 122. By cooperation of the separation roller 121 and the separation pad 122, the uppermost paper sheet will be separated from the stack of paper sheets so that only one paper sheet is picked to implement associated operations such as scanning, faxing, scanning operations and the like.

The sheet-separating structure 12 of the document-feeding device 1, however, still has some drawbacks. For example, it is difficult to elaborately control transfer of the paper sheet by means of only the separation roller 121, which is arranged on one side of the paper sheet. In addition, although the separation pad 122 is in contact with the paper sheet for offering a frictional force, the separation pad 122 lacks the function of directly driving movement of the paper sheet. Under this circumstance, the separation pad 122 is readily abraded and the operating life thereof is often reduced.

SUMMARY OF THE INVENTION

It is an object of the present invention to provide a document-feeding device having an improved sheet-separating structure, in which a pinch roller is contacted with the separation roller to facilitate elaborately controlling transfer of the paper sheet while reducing abrasion of the separation pad and increasing the operating life of the separation pad.

In accordance with an aspect of the present invention, there is provided a document-feeding device. The document-feeding device includes a sheet-feeding channel and a sheet-separating structure. The sheet-separating structure includes a base, a separation pad, a pinch roller, a separation roller and an elastic element. The base is disposed in the sheet-feeding channel. The separation pad is disposed on a surface of the base. The pinch roller is disposed in the base. The separation roller is in contact with the separation pad and the pinch roller. The elastic element is used for supporting the base such that the separation pad and the pinch roller are sustained against the separation roller.

In an embodiment, the base is received in a recess structure of the sheet-feeding channel.

In an embodiment, the document-feeding device further includes a sheet pick-up roller within the sheet-feeding channel for transporting a paper sheet to the sheet-separating structure through the sheet-feeding channel.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
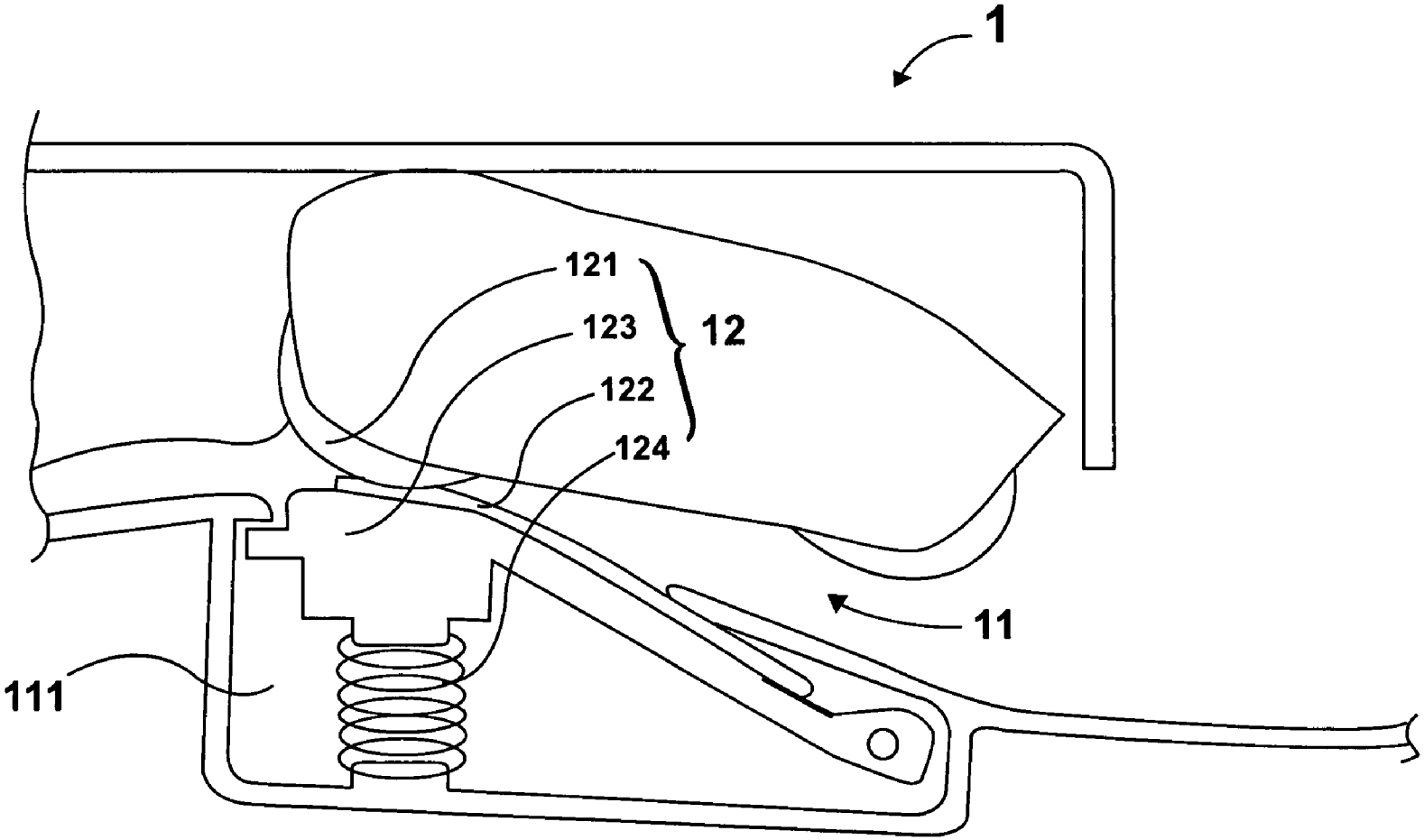
FIG.1 (Prior Art)
FIG. 1 is a schematic partial cross-sectional view of a conventional document-feeding device.
Figure 2:
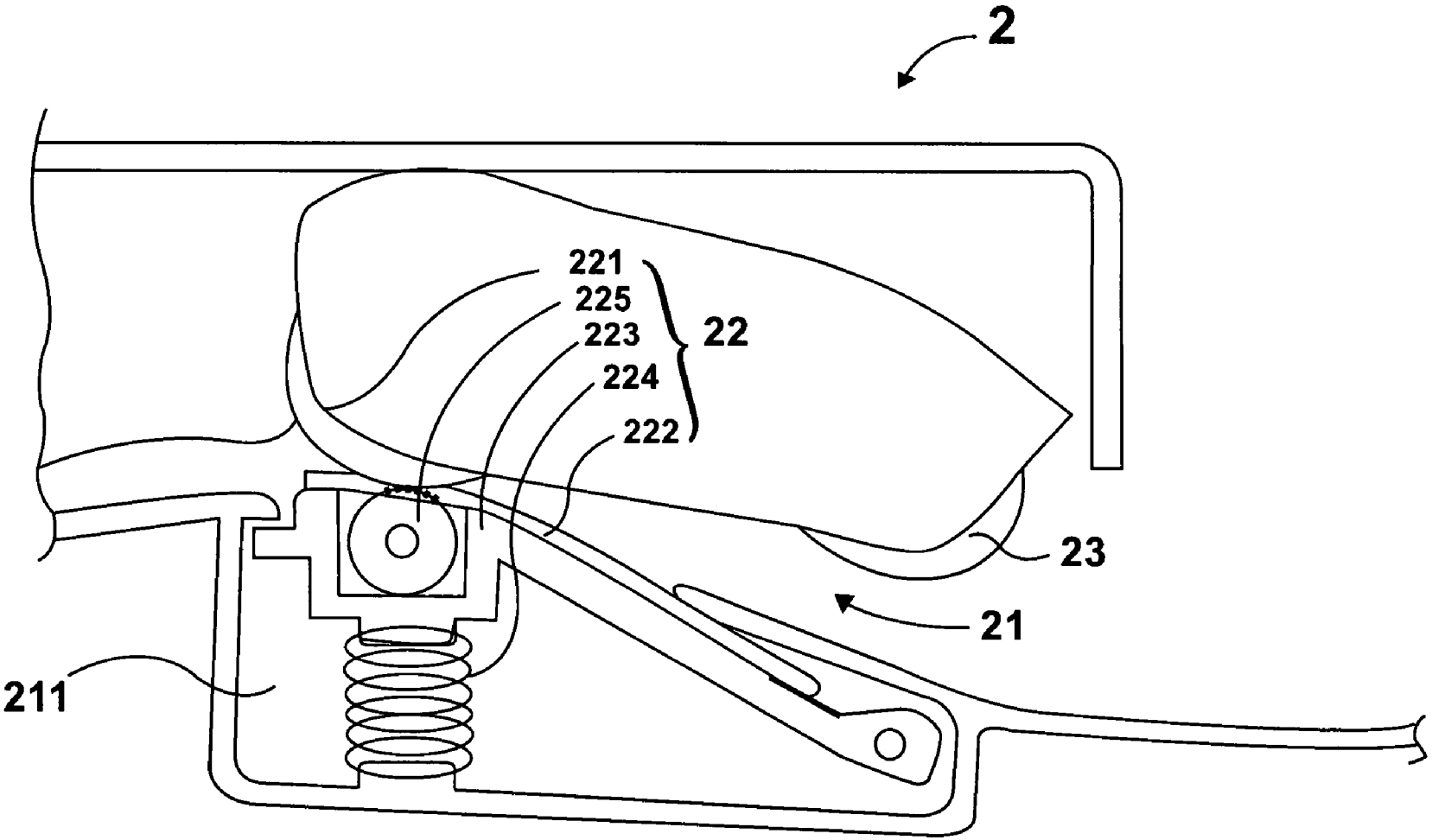
FIG. 2 is a schematic partial cross-sectional view illustrating a document-feeding device having an improved sheet-separating structure according to a preferred embodiment of the present invention.

Please refer to FIG. 2, which is a schematic partial cross-sectional view illustrating a document-feeding device having an improved sheet-separating structure according to a preferred embodiment of the present invention. The document-feeding device 2 principally includes a sheet-feeding channel 21, a sheet-separating structure 22 and a sheet pick-up roller. The sheet-feeding channel 21 is used to support the paper sheets. The sheet-separating structure 22 is disposed within the sheet-feeding channel 21, and includes a separation roller 221, a separation pad 222, a base 223, an elastic element 224 and a pinch roller 225. The rotation of the separation roller 221 may facilitate transport of the paper sheet. When the frictional force between the paper sheet and the separation roller 221 is greater than the frictional force between the paper sheets or greater than the paper sheet and the separation pad 222, the uppermost paper sheet (i.e. the closest paper sheet to the separation roller 221) is nipped between the separation roller 221 and the separation pad 222. In addition, the sheet pick-up roller 23 is disposed within the sheet-feeding channel 21 for transporting the paper sheet to the sheet-separating structure 22 through the sheet-feeding channel 21.

Please refer to FIG. 2 again. The base 223 of the sheet pick-up roller 23 is received in a recess structure 211 within the sheet-feeding channel 21 for supporting the separation pad 222 and the pinch roller 225. The separation pad 222 is attached on the surface of the base 223. Since the surface of the separation pad 222 has high coefficient of friction, the paper sheets underlying the uppermost paper sheet are hindered from advancing. The pinch roller 225 is rotatably coupled to the base 223. In the sheet-separating structure 22 of FIG. 2, the separation roller 221 and the base 223 are respectively arranged at the upper side and lower sides of the sheet-feeding channel 21. The separation pad 222 is arranged between the separation roller 221 and the base 223. As a consequence, the separation roller 221 are contacted with both of the separation pad 222 and the pinch roller 225 to implement the functions of separating and transporting the paper sheet. Moreover, the elastic element 224 is disposed in the recess structure 211 for supporting the base 223 such that the separation pad 222 and the pinch roller 225 are always sustained against the separation roller 221.

Please refer to FIG. 2 again. Since the sheet-separating structure 22 of the document-feeding device 2 of the present invention has a pinch roller 225 in contact with the separation roller 221, the cooperation of the pinch roller 225 and the separation roller 221 may facilitate elaborately controlling transfer of the paper sheet and reducing abrasion of the separation pad 222.

Figure 3:
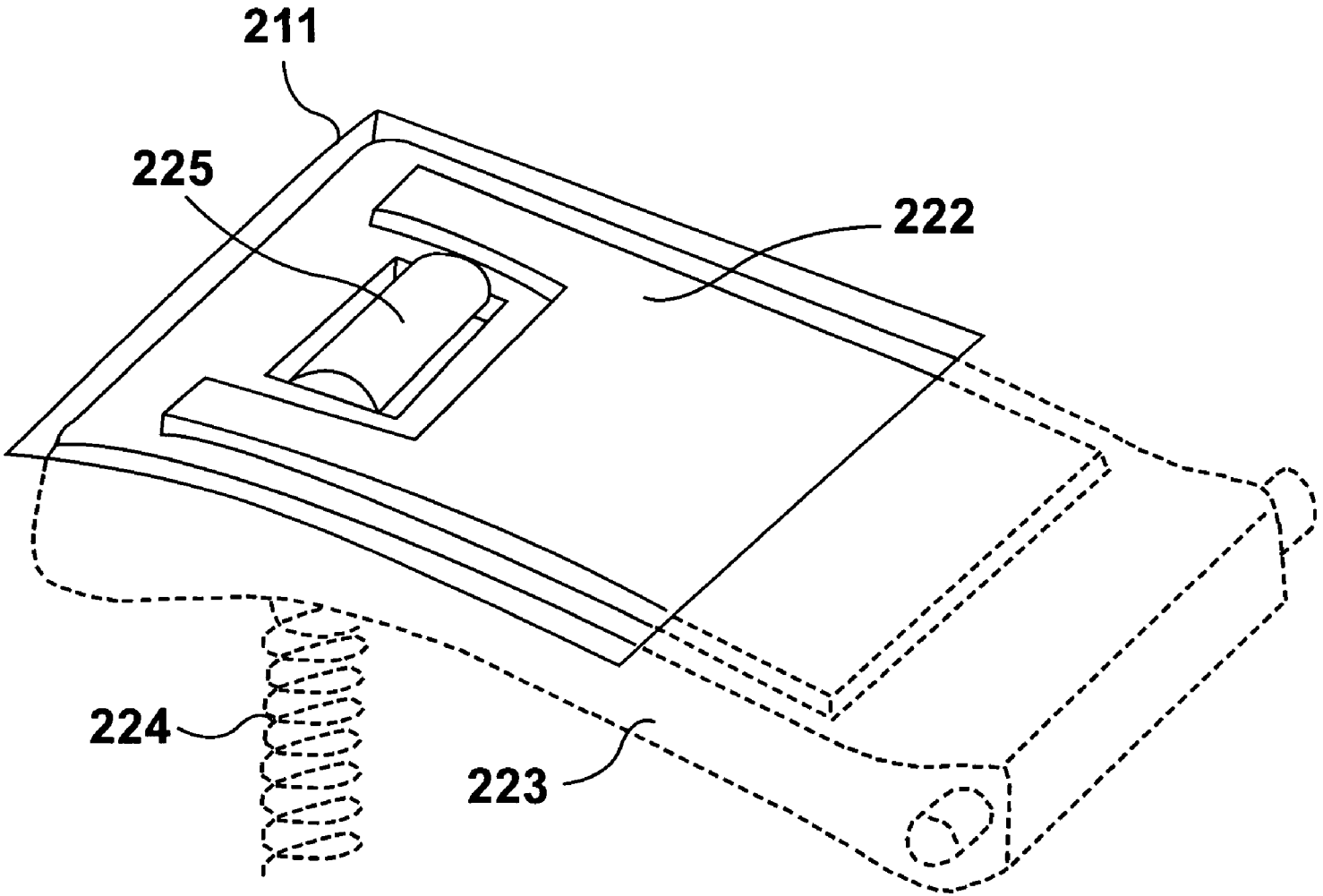
FIG. 3 is a schematic partial perspective view illustrating the separation roller, the separation pad, the base, the elastic element and the pinch roller of the sheet-separating structure.

FIG. 3 is a schematic partial perspective view illustrating the separation roller 221, the separation pad 222, the base 223, the elastic element 224 and the pinch roller 225 of the sheet-separating structure 22. As shown in the perspective view of FIG. 3, the pinch roller 225 is received in the base 223. In addition, the pinch roller 225 is positioned within the separation pad 222. As a consequence, the separation roller 221 is contacted with both of the separation pad 222 and the pinch roller 225 to implement the functions of separating and transporting the paper sheet.

In the above embodiment, the pinch roller 225 is surrounded by the separation pad 222 on at least three sides. It is noted that, however, those skilled in the art will readily observe that numerous modifications and alterations may be made as long as the separation roller are contacted with both of the separation pad and the pinch roller to implement the functions of separating and transporting the paper sheet. Moreover, the number of pinch rollers may be increased as required.

In the above embodiments of document-feeding devices 2, the sheet-feeding channel 21 is horizontally arranged. Alternatively, the sheet-feeding channel 21 may be horizontally or aslant arranged.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A document-feeding device comprising:

a sheet-feeding channel; and a sheet-separating structure comprising:

a base disposed in said sheet-feeding channel;

a separation pad disposed on a surface of said base;

a pinch roller mounted to said base and surrounded by said separation pad on at least three sides;

a separation roller in contact with said separation pad and said pinch roller; and an elastic element for supporting said base such that said separation pad and said pinch roller are sustained against said separation roller; wherein the pinch roller is positioned within the separation pad so that the separation roller is in contact with said separation pad and said pinch roller simultaneously.

2. The document-feeding device according to claim 1 wherein said base is received in a recess structure of said sheet-feeding channel.

3. The document-feeding device according to claim 1 further including a sheet pick-up roller within said sheet-feeding channel for transporting a paper sheet to said sheet-separating structure through said sheet-feeding channel.

4. A document-feeding device comprising:

a sheet-feeding channel for receiving documents therein in a feed-in direction; and a sheet-separating structure comprising:

a base disposed in said sheet-feeding channel;

a separation pad disposed on a surface of said base;

a pinch roller mounted to said base;

a separation roller; and an elastic element for supporting said base such that said separation pad and said pinch roller are sustained against said separation roller; wherein said pinch roller and said separation pad are disposed in the same line perpendicularly to the feed-in direction so that said separation roller is in contact with said separation pad and said pinch roller simultaneously to separate and transport said documents.

* * * * *